US007900951B2

(12) United States Patent
Farges

(10) Patent No.: US 7,900,951 B2
(45) Date of Patent: Mar. 8, 2011

(54) HEEL PIECE OF A BINDING FOR A SKI BOOT, OF THE FIXED BODY TYPE

(75) Inventor: Frédéric Farges, Rue Séraphin Martin (FR)

(73) Assignee: Skis Rossignol, Moirans (FR)

( * ) Notice: Subject to any disclaimer, the term of this patent is extended or adjusted under 35 U.S.C. 154(b) by 807 days.

(21) Appl. No.: 11/904,121

(22) Filed: Sep. 26, 2007

(65) Prior Publication Data

US 2008/0073876 A1 Mar. 27, 2008

(30) Foreign Application Priority Data

Sep. 27, 2006 (FR) ..... 06 08469

(51) Int. Cl.
*A63C 9/00* (2006.01)

(52) U.S. Cl. ..... 280/623; 280/627; 280/631; 280/632

(58) Field of Classification Search ..... 280/611, 280/616, 617, 623, 627, 631, 632
See application file for complete search history.

(56) References Cited

U.S. PATENT DOCUMENTS

| | | | | |
|---|---|---|---|---|
| 3,527,468 | A * | 9/1970 | Ludwig | 280/632 |
| 3,677,566 | A * | 7/1972 | Lawrence | 280/631 |
| 3,724,868 | A * | 4/1973 | Beyl | 280/631 |
| 4,066,277 | A * | 1/1978 | Murata | 280/626 |
| 4,602,804 | A * | 7/1986 | Spitaler et al. | 280/632 |
| 4,773,669 | A * | 9/1988 | Peyre | 280/632 |
| 4,998,747 | A * | 3/1991 | Dimier et al. | 280/631 |
| 5,326,127 | A | 7/1994 | Mercat et al. | |
| 5,913,531 | A * | 6/1999 | Buquet | 280/626 |
| 6,206,404 | B1 | 3/2001 | Buquet et al. | |
| 6,296,267 | B1 | 10/2001 | Buquet | |
| 6,786,501 | B2 * | 9/2004 | Derisoud et al. | 280/623 |
| 2005/0110241 | A1 * | 5/2005 | Buquet et al. | 280/631 |

FOREIGN PATENT DOCUMENTS

| | | |
|---|---|---|
| DE | 41 20 253 A | 12/1992 |
| EP | 0 893 146 A | 1/1999 |
| EP | 0 985 434 A | 3/2000 |
| FR | 2 765 115 A | 12/1998 |
| FR | 2 784 902 A | 4/2000 |

* cited by examiner

*Primary Examiner* — J. Allen Shriver, III
*Assistant Examiner* — John R Olszewski
(74) *Attorney, Agent, or Firm* — Frommer Lawrence & Haug LLP; Ronald R. Santucci

(57) ABSTRACT

A heel piece of a safety binding for a ski boot that is able to occupy at least two positions, an open position and a closed position in which it is able to hold a ski boot securely for skiing, the heel piece comprising a body (11) that occupies the same position in each of these two positions of the heel piece, the body (11) comprising a release mechanism to allow the boot to be released in the closed position of the heel piece if a force exceeds a predetermined level, the heel piece further comprising a lever (12) comprising jaws (14) in its anterior part, these being able to collaborate with the heel of a ski boot, the lever (12) being mounted so that it can rotate relative to the body (11) about a pivot (13) so as to occupy two different positions corresponding to the two, open and closed, positions of the heel piece, wherein at least one end of the pivot (13) is held near the body (11) of the heel piece.

9 Claims, 3 Drawing Sheets

HEEL PIECE OF A BINDING FOR A SKI BOOT, OF THE FIXED BODY TYPE

This application claims priority benefits from French Patent Application No. 06 08469 filed Sep. 27, 2006, the disclosure of which is hereby incorporated by reference.

BACKGROUND OF THE INVENTION

The invention relates to a heel piece of a safety binding of the "fixed body" type for a ski boot, that is to say to a device intended to hold the back of a boot securely on a ski by exerting pressure on the heel of the boot while at the same time pushing the entire boot forward against a front binding device, and automatically releasing the rear of the boot should the skier fall forward. It also relates to a ski to which such a heel piece is attached and to a method of manufacturing such a heel piece.

DESCRIPTION OF THE PRIOR ART

A first family of heel pieces of the prior art said to be of the "moving body" type, relies on a moving body able to occupy a closed position and an open position, comprising at its front end a jaw to grip the heel of a boot in the closed position, and in its rear part a mechanism to implement the release function that allows the rear of the boot to be released if a significant force is exerted, as it would be if the skier were to fall forward. This body is able to move to occupy the closed position for skiing and the open position in which the skier can remove his boot. Examples of heel pieces of this first family are described in patents FR2765115 and EP0893146, which describe a tubular cylindrical body comprising a heel grip at one end, this being articulated such that it can rotate about a cam formed in a cylindrical component that forms part of a U-shaped stirrup the two arms of which are connected to a plate pivotably mounted on the ski. This tubular body uses the release function that allows the rear of the boot to be released if a significant force is exerted, as it would be if the skier were to fall forward. To do that, it generally comprises a helical spring, working in compression between a piston bearing against the cam and an end stop situated toward the opposite end to the cam. The shape of the cam is such that, under the pressure of the spring, the boot, once in the binding, is pushed toward the front against the front binding and downward against the ski. Only a significant force is able to cause the body to pivot about the cam, thereby pushing back the piston and compressing the spring, causing the heel piece to open. These heel pieces, which are very expensive, rely on a single body combining all the essential functions of the binding, and have release mechanisms that allow the binding to release at very high forces, particular well suited to competitive skiing.

The present invention is concerned with a second family of heel pieces said to be of the "fixed body" type, which are less expensive because of their very different and simpler nature, relying on a fixed body comprising the heel piece release mechanism and on a simpler separate element able to rotate relative to this body, of the lever type comprising, at its front end, a jaw iron to grip the heel of a boot. Rotating this "jaw lever" relative to the fixed body allows the heel piece to occupy the two, closed and open, positions for binding or releasing a ski boot. Document FR2784902 discloses one example of such a heel piece, which is illustrated in FIG. 1. The two, open and closed, positions of the heel piece are obtained by rotating a moving lever 2 about a pivot 3 of the fixed body 1 comprising the release mechanism. The lever 2 comprises jaw irons 4 in its anterior part and its rear part 5 can be actuated to open the jaw iron 4. According to the solutions of the prior art, this jaw iron lever 2 straddles the body 1 and therefore laterally, particularly in the region of the pivot 3, has slim lateral arms 6. This construction has a number of disadvantages:

- first, the slim lateral arms 6 mean that the lever 2 has to be made of a very rigid material so that the arms can withstand the various stresses to which they are exposed, such as when heading the metal pivot 3 during manufacture of the heel piece, then the stresses of edging the skis when skiing, and the forces of the boot on the heel piece, because the load from the skier to the ski passes through the jaw irons 4 of the lever 2 then through the pivot 3 of the heel piece, via the arms 6;
- second, the jaw irons 4 of the lever 2 require a material of a particular coefficient of friction so as to allow the boot to slide free when the binding is released. Now, the levers 2 of the prior art are of a shape that involves a significant amount of material in order to meet the two requirements of rigidity and coefficient of friction, and this is expensive; and
- last, this solution requires heel pieces that are wide, and ill suited to reducing the width of the skis.

SUMMARY OF THE INVENTION

It is an object of the present invention to propose a fixed body heel piece that does not have the above disadvantages.

More specifically, it is an object of the invention to propose a fixed body heel piece that is less expensive but maintains optimum rigidity and, more generally, good performance.

The invention achieves the above objectives by proposing for the pivot to be held on a fixed body rather than on the lever, thus also allowing the lever to be simplified.

More specifically, the invention relates to a heel piece of a safety binding for a ski boot that is able to occupy at least two positions, an open position and a closed position in which it is able to hold a ski boot securely for skiing, the heel piece comprising a body that occupies the same position in each of these two positions of the heel piece, the body comprising a release mechanism to allow the boot to be released by the opening of the heel piece if a force exceeds a predetermined level, the heel piece further comprising a lever comprising jaw in its anterior part, these being able to collaborate with the heel of a ski boot, the lever being mounted so that it can rotate relative to the body about a pivot so as to occupy two different positions corresponding to the two, open and closed, positions of the heel piece, wherein at least one end of the pivot is held near the body of the heel piece.

The anterior part of the fixed body may form a fork and the pivot about which the lever rotates may be held directly at the lateral arms of the fork at its ends.

The two ends of the pivot about which the lever rotates may be fixed to the outer lateral faces of the arms of the fixed body by a method of the heading type.

The lever may have a part through which the pivot passes, this part being positioned between the two lateral arms of the fixed body.

The jaw may have a lateral surface in the continuation of the anterior lateral surface of the arms of the body.

According to an advantageous variant, the lever does not have a thin lateral surface laterally covering the lateral arms of the body.

The part of the lever to the rear of the jaw irons may essentially lie in a volume positioned above the body, laterally not extending beyond the vertical planes delimited by the exterior lateral surfaces of the arms of the body.

For that, the part of the lever to the rear of the jaw irons may be delimited by two lateral edges which converge upon one another in the direction toward the rear of the heel piece.

The invention also relates to a method of manufacturing a heel piece of a safety binding for a ski boot as defined hereinabove, and which comprises the step of holding the ends of the pivot directly on the body, for example using heading.

Finally, the invention also relates to a ski comprising a heel piece of a safety binding for a ski boot as defined hereinabove.

DESCRIPTION OF THE DRAWINGS

These objects, features and advantages of the present invention will be explained in detail in the following description of one particular embodiment which is given without implying any limitation and in relation to the attached drawings among which.

DESCRIPTION OF THE PREFERRED EMBODIMENT

Figure 1:
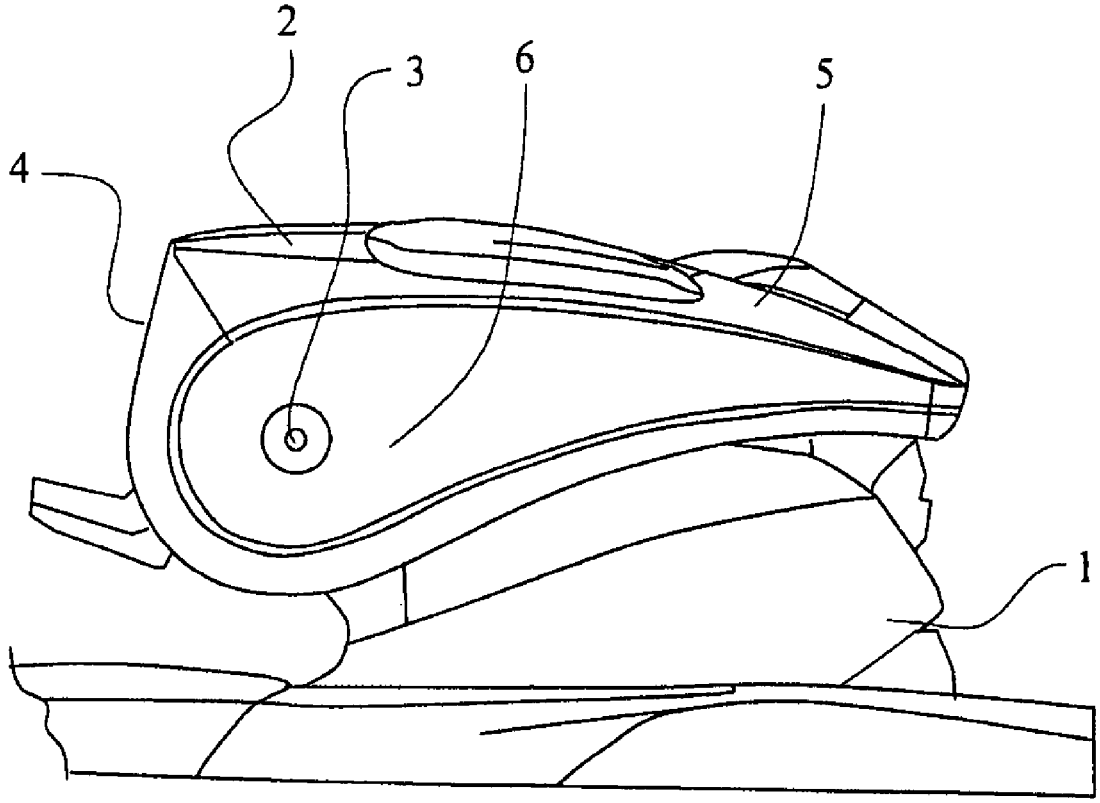
FIG. 1 depicts a fixed body heel piece according to the prior art.

According to the embodiment of the invention that is depicted in FIGS. 2 to 5, the heel piece comprises a fixed body 11 including the release mechanism, that is to say essentially the release spring bearing against a cam acting on the pivot 13 of the jaw 14, according to a principle known from the prior art.

The body 11 in its anterior part forms a fork comprising thick lateral arms 17 between which part 19 of the jaw lever 12 is positioned and to which the ends of the pivot 13 about which the jaw iron lever 12 rotates are fixed directly, for example by heading on their exterior lateral surface. This body 11 is associated in the known way with a separate base comprising a housing to accommodate the ski brake.

The lever 12 comprises jaws 14 in its anterior part, the dimensions of these being standardized and identical to the jaws of the prior art. However, the lever no longer comprises lateral arms 6 straddling the body 11 as it did in the prior art. The jaw irons 14 have a small-sized lateral surface 16 positioned in the continuation of the lateral surfaces of the lateral arms 17 of the body 11. The remainder of the lever 12 has a relatively flat, narrow and profiled shape, its two lateral edges 18 remaining positioned above the body 11 and converging upon one another toward the rear part of the lever 12, which comprises a part 15 designed for actuating the lever 12, in order to open and close the heel piece. To limit the risks of contact with the edges of the skis, the part of the lever 12 to the rear of the jaw irons 14 is confined to a narrow volume above the body 11, delimited by the vertical lateral planes defined by the lateral surfaces of the arms 17 of the body 11 and the lateral surfaces 16 of the jaw irons 14. These surfaces 16 are the surfaces of the jaw iron lever 12 most exposed to being knocked by the edges of the skis. As, on the whole, they have a small surface area and are also positioned in the continuation of the lateral surfaces 17 of the body 11, they are very well protected. This embodiment minimizes the risk of attack to the lever, which can therefore be made of a material that is not as strong as was used in the prior art, and in which the openings 20 can be made, in order to reduce the amount of material needed while at the same time offering an attractive look.

Figure 5:
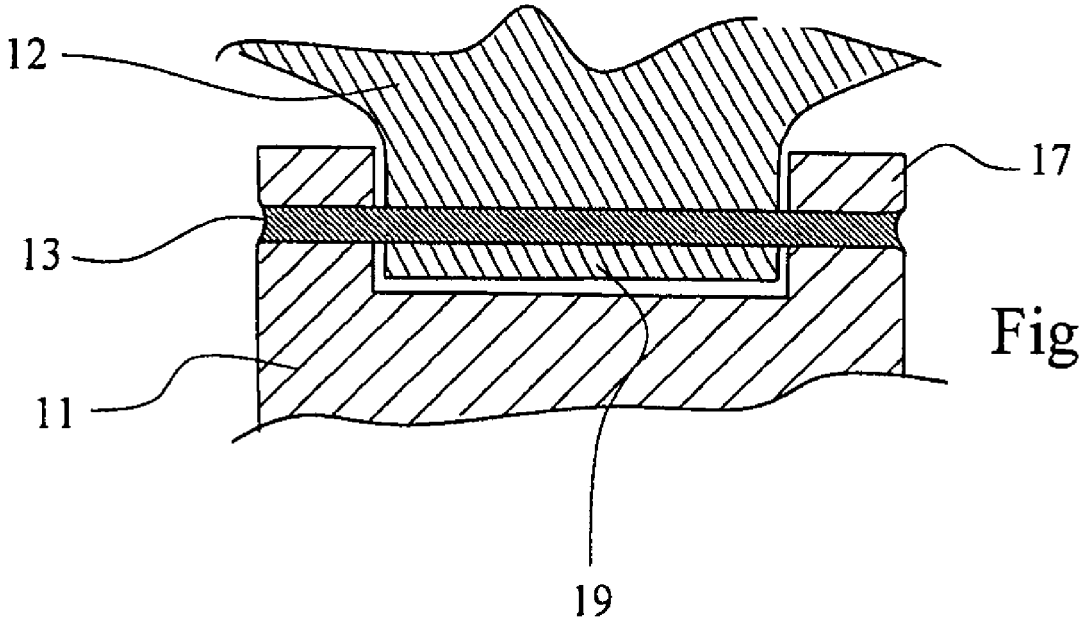
FIG. 5 illustrates a schematic view in section V-V of the heel piece according to one embodiment of the invention.

FIG. 5 illustrates a cross section through the heel piece at the pivot 13. The arms 17 of the body 11 occupy the lateral parts and directly accept the fixtures for the pivot 13, the ends of which are positioned at their lateral faces. The lever 12 has a part 19 through which the pivot 13 passes, more or less centrally, between the two arms 17 of the body 11. In this embodiment variant, the forces to which the lever 12 is subjected during rotational movements are better distributed.

The invention also relates to the method of manufacturing a fixed body heel piece of a ski binding which involves the step of securing the ends of the pivot 13 about which the lever 12 rotates directly to the body 11, for example by heading on the exterior lateral surfaces of the arms 17. These arms 17 are thick and strong and can easily withstand this operation, together with any future knocks received, for example, from the edges of the ski. As an alternative, any other method making it possible to hold this pivot 13 in terms of translational movement on the body 11 may suit, for example based on the use of rivets, screws pressing against the pivot, or clips, or even by simply force-fitting the pivot into a small-diameter opening in the knowledge that the translational forces to which the pivot is subjected are relatively small.

Figure 3:
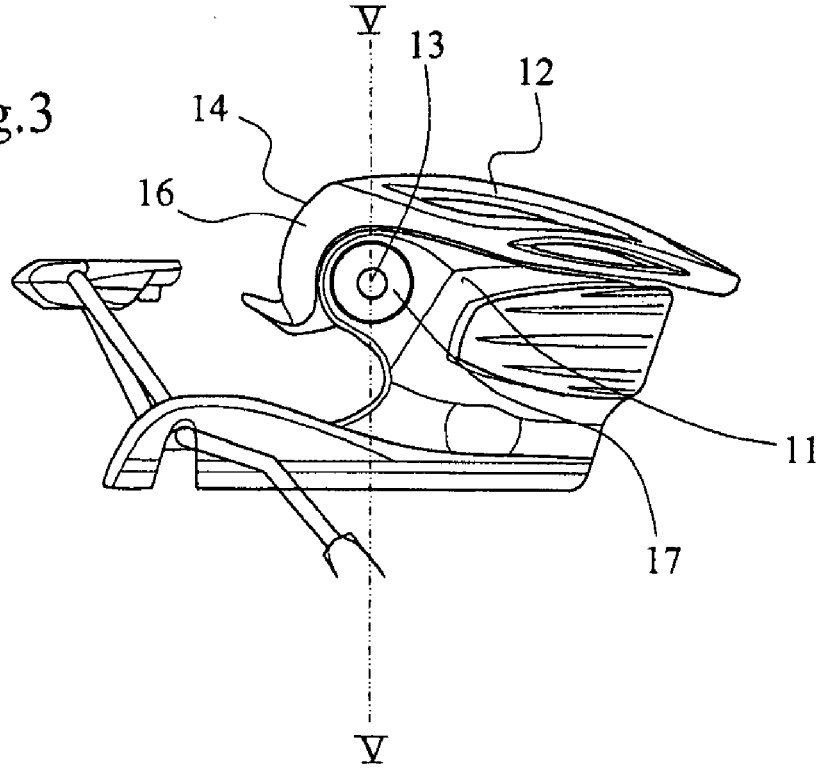
FIG. 3 depicts a side view of the heel piece according to the embodiment of the invention, in the open position.
Figure 4:
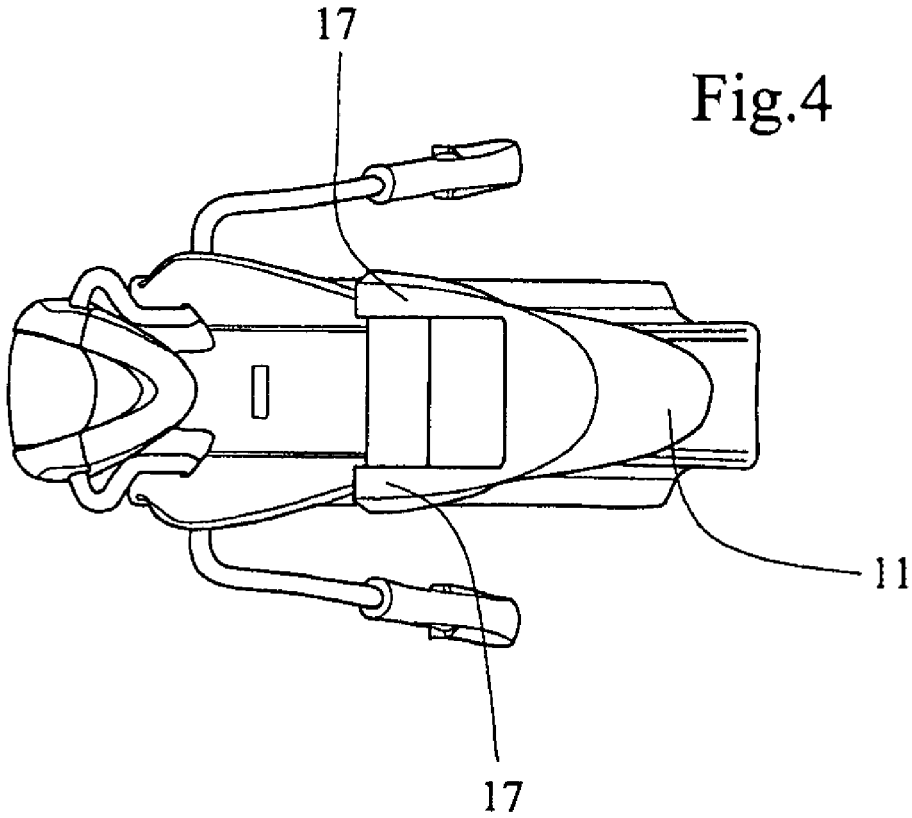
FIG. 4 depicts a view from above of the body and of the base of the brake of the heel piece according to the embodiment of the invention.

The preferred embodiment of the invention has been described nonlimitingly with reference to FIGS. 3 and 4. Other embodiment variants that remain within the concept of the invention are conceivable.

For example, any solution whereby at least one end of the pivot 13, and preferably both ends, is fixed directly to the fixed body 11 rather than to the lever 12 makes it possible to achieve the advantage of lower stresses applied to the lever 12, whatever form this lever takes.

Second, a form of lever 12 in which the lateral arms of the lever are entirely eliminated, or simply of smaller surface area, makes it possible to achieve an additional advantage of lower vulnerability to knocks when skiing.

Figure 2:
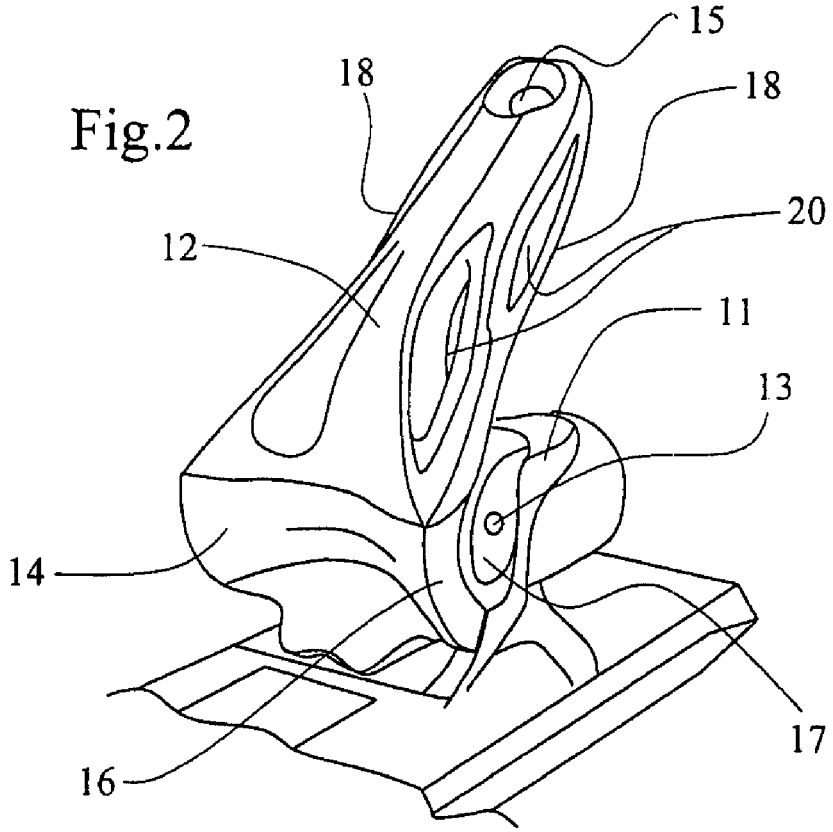
FIG. 2 depicts a front perspective view of a heel piece according to one embodiment of the invention, in the closed position.

Finally, the invention clearly achieves the desired objectives and displays the following advantages:

- the pivot 13 is no longer fixed to the arms of the lever 12, and this dispenses with one of the stresses to which the lever is subjected and allows the lever to be simplified and/or made of a less rigid material;
- since the pivot 13 is fixed directly to the fixed body 11 by heading, it is also fixed, whereas in the solutions of the prior art, it would turn with the jaw iron lever 12. Immobilizing this pivot therefore has the additional advantage of reducing the mechanical stresses in the heel piece as a whole, and therefore of restricting the wearing thereof;
- in the variant depicted, the lever 12 no longer has any slim lateral arms and is far less, if at all, subject to attack by the edges of a ski, by comparison with the prior art. That further enhances the possibility of using a less rigid material from which to make this element;
- this new heel piece structure makes it possible to reduce the overall amount of material used for the jaw iron lever 12, making it possible, if using the same material as the prior art, to obtain a lever that is less expensive;
- the volume of the heel piece is small, thus reducing the space it occupies and allowing it to be incorporated into narrower skis;
- the body 11 of the heel piece experiences new stresses, in place of the lever 12. However, since these stresses are exerted on thick and strong portions, they have no impact on the structure of the heel piece; and finally, this solution allows the heel piece to achieve a new more attractive look because of the possibility of giving the lever 12 a profiled shape as depicted in FIGS. 2 and 3.

The invention claimed is:

1. A heel piece of a safety binding for a ski boot that is able to occupy at least two positions, an open position and a closed position in which it is able to hold a ski boot securely for skiing, the heel piece comprising a body (11) that occupies the same position in each of these two positions of the heel piece, the body (11) comprising a release mechanism to allow the boot to be released by the opening of the heel piece if a force exceeds a predetermined level, the heel piece further comprising a lever (12) comprising jaws (14) in its anterior part, these being able to collaborate with the heel of a ski boot, the lever (12) being mounted so that it can rotate relative to the body (11) about a pivot (13) so as to occupy two different positions corresponding to the two, open and closed, positions of the heel piece, at least one end of the pivot (13) being held near the body (11) of the heel piece, wherein the jaws (14) have a lateral surface (16) approximately in the continuation of the anterior lateral surface of the arms (17) of the body (11), and the lever does not comprise lateral arms straddling the body (11) in the region of the pivot (13).

2. The heel piece of a safety binding for a ski boot as claimed in claim 1, wherein the anterior part of the fixed body (11) forms a fork and the pivot (13) about which the lever (12) rotates is fixed directly to the lateral arms (17) of the fork at its ends.

3. The heel piece of a safety binding for a ski boot as claimed in claim 2, wherein the two ends of the pivot (13) about which the lever (12) rotates are held at the outer lateral faces of the arms (17) of the fixed body (11) by a method of the heading type.

4. The heel piece of a safety binding for a ski boot as claimed in claim 2, wherein the lever (12) has a part (19) through which the pivot (13) passes, this part being positioned between the two lateral arms (17) of the fixed body (11).

5. The heel piece of a safety binding for a ski boot as claimed in claim 1, wherein the part of the lever (12) to the rear of the jaws (14) essentially lies in a volume positioned above the body (11), laterally not extending beyond the vertical planes delimited by the exterior lateral surfaces of the arms (17) of the body (11).

6. The heel piece of a safety binding for a ski boot as claimed claim 5, wherein the part of the lever (12) to the rear of the jaws (14) is delimited by two lateral edges (18) which converge upon one another in the direction toward the rear of the heel piece.

7. The heel piece of a safety binding for a ski boot as claimed in claim 1, wherein a portion of the lever (12) situated at the rear of the jaws (14) is delimited by vertical lateral planes of the arms (17) and the lateral surfaces (16) of the jaws (14).

8. A method of manufacturing a heel piece of a safety binding for a ski boot as claimed in claim 1, and which comprises the step of holding the ends of the pivot (13) directly on the body (11) by using heading, and wherein the jaws (14) have a lateral surface (16) approximately in the continuation of the anterior lateral surface of the arms (17) of the body (11)), and the lever does not comprise lateral arms straddling the body (11) in the region of the pivot (13).

9. A ski comprising a heel piece of a safety binding for a ski boot as claimed in claim 1.

* * * * *